US006034313A

United States Patent [19]

Shelley

[11] Patent Number: 6,034,313

[45] Date of Patent: Mar. 7, 2000

[54] TONAL CYMBAL

[75] Inventor: Thomas W. Shelley, Struther, Ohio

[73] Assignee: Universal Percussion, Inc., Columbiana, Ohio

[21] Appl. No.: 09/239,212

[22] Filed: Jan. 28, 1999

Related U.S. Application Data

[60] Provisional application No. 60/082,338, Apr. 20, 1998.

[51] Int. Cl.[7] ..... G10D 13/02

[52] U.S. Cl. ..... 84/422.3; 84/402

[58] Field of Search ..... 84/422.3, 402

[56] References Cited

U.S. PATENT DOCUMENTS

| | | | |
|---|---|---|---|
| D. 297,015 | 8/1988 | Hargrove . | |
| D. 301,893 | 6/1989 | Hargrove . | |
| 2,559,143 | 7/1951 | Zildjian . | |
| 3,453,923 | 7/1969 | Paiste | 84/402 |
| 3,546,994 | 12/1970 | Paiste . | |
| 3,592,097 | 7/1971 | Friede . | |
| 3,640,029 | 2/1972 | Zildjian | 451/53 |
| 3,677,127 | 7/1972 | Garven . | |
| 4,114,502 | 9/1978 | Zildjian . | |
| 4,248,129 | 2/1981 | Zildjian . | |
| 4,320,687 | 3/1982 | Kidwell | 84/402 |
| 4,677,892 | 7/1987 | Kramer et al. . | |
| 4,718,964 | 1/1988 | Sawada et al. | 156/252 |
| 4,787,876 | 11/1988 | Nguyen et al. | 446/408 |
| 4,807,510 | 2/1989 | Croteau . | |
| 4,809,581 | 3/1989 | Paiste, Sr. et al. . | |
| 4,911,056 | 3/1990 | Belli et al. . | |
| 5,266,733 | 11/1993 | Jacobson . | |
| 5,367,939 | 11/1994 | Barker . | |
| 5,639,976 | 6/1997 | Manoff et al. . | |

*Primary Examiner*—David Martin
*Assistant Examiner*—Shih-yung Hsieh
*Attorney, Agent, or Firm*—Vickers, Daniels & Young

[57] ABSTRACT

A cymbal made of a sound producing a plate which includes a plurality of linear tonal grooves. The tonal grooves are positioned on the top and/or bottom surface of the cymbal. The tonal grooves extend substantially from the center of the cymbal and/or from a point spaced from the center of the cymbal. The tonal grooves extend substantially to the edge of the cymbal and/or extend to a point which is spaced from the edge of the cymbal.

53 Claims, 6 Drawing Sheets

TONAL CYMBAL

The present invention claims priority on co-pending U.S. Provisional Patent Application Ser. No. 60/082,338 filed Apr. 20, 1998 titled Improved Cymbal. The invention pertains to the art of musical instruments and more particularly to cymbals. The invention specifically pertains to a modified cymbal that includes a unique design to produce a richer and fuller sounds when the cymbal is struck.

INCORPORATION BY REFERENCE

U.S. Pat. Nos. D301,893; D297,015; 4,320,687; 4,114,502; and 4,807,510 are incorporated herein by reference as background information on prior cymbal designs.

BACKGROUND OF THE INVETION

A conventional cymbal comprised as a concave circular disc or plate, usually made of brass or bronze. The tone of high quality cymbals contain a blend of virtually all the notes of the scale or their harmonic compliments, made up of a fundamental tone or bell tone, and overtones. Cymbals can vary from one another quite distinctly in tone. Cymbals of a seeming identity may have a distinct tone, according to its unique dominate pitch in response to sympathetic vibration. The usual sound affect desired from a cymbal is a "crash."

Cymbals are made in various categories according to variations in size, weight, surface curvature, the latter variation including various tapers, surface curvature varying from a substantially uniform or flat topped curvatures to those having a central cup or bell, which is of a shorter radius in the remainder or bow of the cymbal and raised above it. Cymbals are also made especially for different uses, such as those played singly, and paired cymbals which are struck together, hand-held or by foot petal stand.

Various attempts have been made to produce a cymbal having an improved sound. Such cymbals are disclosed is U.S. Pat. Nos. D301,893; D297,015; 4,320,687; 4,114,502; and 4,807,510. U.S. Pat. No. D297,015 discloses an octagon shaped cymbal. U.S. Pat. No. D301,893 discloses a circular cymbal having pitted regions randomly dispersed throughout the top of the cymbal. U.S. Pat. No. 4,114,502 discloses a cymbal have multiple mounting apertures at the top of the cymbal. U.S. Pat. No. 4,320,687 discloses an elliptical cymbal. U.S. Pat. No. 4,807,510 discloses an idiophone having an expandable and contractible plate to produce a vibrating sound when struck.

Cymbals have been designed to include circular tonal grooves. These tonal grooves are in the shape of circular arcs which increase in diameter from the center of the cymbal. Score lines have also been added to cymbals. Score lines are non-uniform grooves that extend from the top to the edge of the cymbal. The score lines have varying widths and depths, are not uniformly spaced from one another, and are limited to a small region on the cymbal. Typically 1–5 score lines are contained in a small region on the cymbal. These cymbals generally 1 to 3 regions of score lines, which are separated from one another on the cymbal.

SUMMARY OF THE INVENTION

The invention pertains to the art of musical instruments and more particularly to musical instruments that are struck to produce a sound. The invention specifically pertains to cymbals that have been modified to include a unique design which produces a richer and fuller sounds when struck and will be described with particular reference thereto; however, the invention has broader applications and can be used in other percussion instruments such as bells, chimes, triangles, xylophone, and the like.

The invention is applicable to all cymbals of all categories, but more particularly cymbals played individually and which are provided with a central aperture to receive a pin on a support stand to suspend the cymbal for playing. The support stand is usually provided with an adjustable top by which the suspension of the cymbal may be varied from horizontal to various angles thereto to suit the convenience of the player.

The improved cymbal includes a unique design that includes the use of a plurality of tonal grooves to produce a rich and vibrant sound. The tonal grooves are designed to radially extend, in a substantially linear fashion, from the center of the cymbal. Thus, such a tonal groove forms a substantially straight line from or near the center of the cymbal toward the peripheral edge of the cymbal. The substantially linear nature of the tonal groove produces a unique and rich sound as compared to prior cymbal designs. It is believed that the substantially linear design of the tonal grooves which extend from or near the center of the cymbal help direct the sound outward from the cymbal thereby producing a higher quality sound than prior cymbal designs. The cymbal can be made up of a variety of materials such as plastic, metal, fiberglass, etc. Preferably the cymbal is made up of copper or brass. The shape of the cymbal is preferably circular; however, other shapes of the cymbal may be used such as elliptical, polygonal, etc. The curvature of the cymbal may also be varied to produce a variety of different sounds. The curvature may range from a substantially flat to a substantially curved surface cymbal. The cymbal preferably includes at least one aperture to receive a pin on a supporting stand to suspend the cymbal for playing. Preferably, one aperture is position substantially at the center of the cymbal. Other apertures can be incorporated in the cymbal to mount the cymbal non-symmetrically on a stand.

In accordance with another aspect of the present invention, the cymbal can have varying thickness to produce different sounds when different regions of the cymbal are struck. The thickness of the cymbal may be designed to uniformly vary or randomly vary. The thickness of the cymbal can varied by changing the thickness of the metal at the top and/or bottom of the cymbal. In an alternate design, the cymbal includes circular ribs extending at least partially about the center of the cymbal. The ribs can be symmetrically and/or non-symmetrically positioned about the center of the cymbal. Each rib can have a uniform or non-uniform height and/or width. In addition, the height and/or width of the ribs may be coordinated to produce a particular tonal sound or random. The one or more ribs can be positioned on the top and/or bottom of the cymbal. Preferably, the thickness of the ribs is at least about 0.005", preferably about 0.01–0.5", and more preferably 0.01–0.1". As can be appreciated, other dimensions can be used to obtained the desired sound from the cymbal.

In accordance with another aspect of the present invention, the tonal grooves extend from or near the center of the cymbal towards the edge of the cymbal. In one preferred embodiment, the tonal grooves extend from at or near the center of the cymbal to substantially the edge of the cymbal. In another preferred embodiment, the tonal grooves extend from at or near the center of the cymbal to a positioned spaced from the edge of the cymbal. In such a spaced relationship, the spacing from the edge of the cymbal is at least about 0.25", and preferably about 0.5–3", and more preferably about 0.5–1". As can be appreciated, other dimensions can be used to obtained the desired sound from the cymbal. In one specific embodiment, the spacing of all the tonal grooves from the edge of the cymbal is substantially uniform. In another specific embodiment, the spacing of one or more of the tonal grooves from the edge of the cymbal is non-uniform. In yet another preferred embodiment, one or more tonal grooves extend from at or near the center of the cymbal to a positioned spaced from the edge of the cymbal. In such a design, the length of the tonal grooves is not uniform on the cymbal. In still another preferred embodiment, the length of the tonal grooves is varied to obtain a desired tone and richness of sound for the cymbal.

In accordance with yet another aspect of the present invention, tonal grooves are positioned on the cymbal so as to extent at or near the center of the cymbal. In one preferred embodiment, the tonal grooves all extend substantially from the center of the cymbal. In another preferred embodiment, the tonal grooves extend from a positioned spaced from the center of the cymbal. In such a spaced relationship, the spacing from the center of the cymbal is at least about 0.25", and preferably about 0.5–3", and more preferably about 0.5–1". As can be appreciated, other dimensions can be used to obtained the desired sound from the cymbal. In one specific embodiment, the spacing of all the tonal grooves from the center of the cymbal is substantially uniform. In another specific embodiment, the spacing of one or more of the tonal grooves from the center of the cymbal is non-uniform. In yet another preferred embodiment, one or more tonal grooves extend substantially from the center of the cymbal, and one or more tonal grooves extend from a position spaced from the center of the cymbal. In such a design, the length of the tonal grooves is not uniform on the cymbal. In still another preferred embodiment, the length of the tonal grooves is varied to obtain a desired tone and richness of sound for the cymbal.

In accordance with still yet another aspect of the present invention, the length of the tonal grooves on the cymbal is substantially uniform. In one preferred embodiment, the length of the tonal grooves is substantially uniform on the top side of the cymbal. In another preferred embodiment, the length of the tonal grooves is substantially uniform on the bottom side of the cymbal. In still another preferred embodiment, the length of the tonal grooves is substantially uniform on the top and bottom side of the cymbal.

In accordance with yet another aspect of the present invention, the tone quality produced from the tonal grooves is controlled by varying the depth of the grooves. The depth of the grooves may be uniform or may be varied along the length of the tonal groove. In addition, the cymbal may be designed so that one or more tonal grooves has a different groove depth than other tonal grooves on the cymbal. In one preferred embodiment, the depth of the tonal grooves are substantially uniform. In another preferred embodiment, the depth of one of more tonal grooves is different from other tonal grooves. In yet another preferred embodiment, the depth of the tonal grooves at substantially uniform on at least one side of the cymbal. Preferably, the depth of the tonal grooves is at least about 0.001", preferably about 0.005–0.1", and more preferably about 0.005–0.05". As can be appreciated, other dimensions can be used to obtained the desired sound from the cymbal.

In accordance with another aspect of the present invention, the tone quality produced from the tonal grooves is controlled by varying the width of the grooves. The width of the grooves may be uniform or may be varied along the length of the tonal groove. In addition, the cymbal may be designed so that one or more tonal grooves has a different groove width than other tonal grooves on the cymbal. In one preferred embodiment, the width of the tonal grooves are substantially uniform. In another preferred embodiment, the width of one of more tonal grooves is different from other tonal grooves. In yet another preferred embodiment, the width of the tonal grooves at substantially uniform on at least one side of the cymbal. Preferably, the width of the tonal grooves is at least about 0.001", preferably about 0.005–0.1", and more preferably about 0.005–0.05". As can be appreciated, other dimensions can be used to obtained the desired sound from the cymbal.

In accordance with still another aspect of the present invention, the tonal grooves are selectively positioned on the bottom and/or top side of the cymbal to achieve the desire tonal quality of the cymbal. In one preferred embodiment, the tonal grooves are positioned only on the bottom side of the cymbal. In another preferred embodiment, the tonal grooves are positioned only on the top side of the cymbal. In still another preferred embodiment of the invention, the tonal grooves are positioned on the top and bottom sides of the cymbal.

In accordance with still yet another aspect of the present invention, the spacing of the grooves from one another is substantially uniform. In one specific embodiment, the tonal grooves are substantially symmetrically oriented on one side of the cymbal. In another specific embodiment, the tonal grooves are substantially symmetrically oriented on both sides of the cymbal. In another embodiment of the present invention, the spacing of a plurality of tonal grooves varies from one another. In one specific embodiment, the tonal grooves are non-symmetrically oriented on one side of the cymbal. In another specific embodiment, the tonal grooves are non-symmetrically oriented on both sides of the cymbal.

In accordance with yet another aspect of the present invention, the tonal grooves extending from at or near the center of the cymbal to at or near the edge of the cymbal are used in combination with other tonal altering modifiers to the cymbal, such as circular tonal grooves, pitted surfaces, score lines, chemical surface treatments (i.e. etching) and coatings (i.e plastic or polymer coating), and the like. In one preferred embodiment, the tonal grooves extending from at or near the center of the cymbal to at or near the edge of the cymbal are positioned on the same side of the cymbal which include one or more other tonal altering cymbal modifiers. In another preferred embodiment, the tonal grooves extending from at or near the center of the cymbal to at or near the edge of the cymbal are positioned on a different side of the cymbal which include one or more other tonal altering cymbal modifiers.

It is accordingly a principal object of the present invention to provide musical instrument with richer and fuller sounds.

Another object of the present invention is the provision of a musical instrument having a plurality of tonal grooves.

Still another object of the present invention is the provision of a musical instrument having substantially straight tonal grooves.

Yet another object of the present invention is the provision of a musical instrument having tonal grooves that forma particular depending on the width, depth, orientation and/or number of tonal grooves.

Still yet another object of the present invention is the provision of a musical instrument having tonal grooves on one or more sides of the musical instrument.

Another object of the present invention is the provision of a musical instrument that has symmetrically oriented tonal grooves.

Yet another object of the present invention is the provision of a musical instrument that has tonal grooves with a substantially uniform length.

Still another object of the present invention is the provision of a cymbal having a plurality of tonal grooves extending substantially linearly from and/or near the center of the cymbal to at and/or near the edge of the cymbal.

Still yet another object of the present invention is the provision of a cymbal having a variety of shapes, sizes and/or thicknesses.

Yet a further object of the present invention is the provision of a cymbal having one or more mounting apertures.

Yet another object of the present invention is the provision of a cymbal having substantially linearly shaped tonal grooves and another tone modifier on the cymbal such as ribs, circular tonal grooves, pitted surfaces, score lines, chemical surface treatments or coatings, and the like.

These and other objects and advantages will become apparent from the following description used to illustrate the preferred embodiment of the invention when read in conjunction with the accompanying drawings.

DESCRIPTION OF THE PREFERRED EMBODIMENTS

Figure 1:
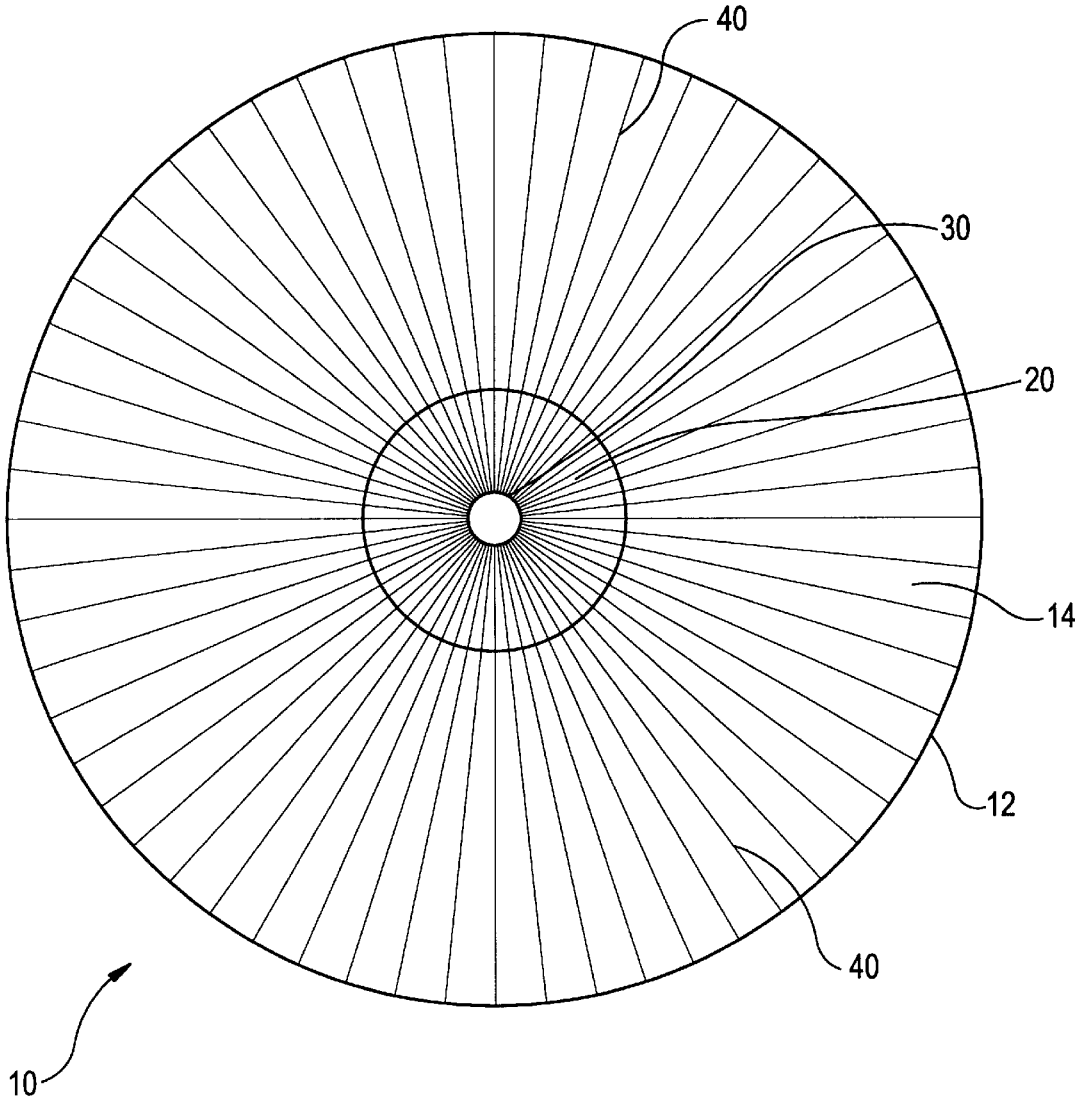
FIG. 1 is a top elevation view of the cymbal having a plurality of tonal grooves in accordance with the present invention.

Referring now to the preferred embodiment of the drawings, wherein the showings are for the purpose of illustrating a preferred embodiment of the invention only and not for the purpose of limiting the invention, FIG. 1 is schematic drawing of a cymbal 10. The cymbal is an annular disc being a conventional flat topped type and size (7–36 in. diameter) which is concavo-convex. The cymbal is made of a resilient material such as copper, bronze, brass, copper alloys, steel, and the like. Preferably the material produces a sustained crash sound when struck by a drum stick, mallet, brush, or other striking device. Cymbal 10 has a substantially smooth peripheral edge 12. In the central portion of the cymbal, this is a circular bell 20 that includes an opening 30. Opening 30 provides a means to mount the cymbal in suspension. Opening 30 is positioned substantially in the center of the bell; however, the opening can be positioned in other locations on the cymbal. Typically cymbal 10 is mounted on a stand so as to be in generally free suspension. The cymbal may be attached to the stand by a threaded cap or the like. This form of mounting, and the alternates thereof, are well known in the art and no further details will be described. Alternatively, opening 30 is used to secure handles to the cymbals for handheld playing of the cymbal. The size and configuration of bell 30 is dependant or the particular sound and use of the cymbal. As can be appreciated, the cymbal can be formed without a bell if desired.

Cymbal 10 is shown as including a plurality of tonal grooves 40. As shown in FIG. 1, the tonal grooves 40 extend from opening 30 toward the peripheral edge 12 of cymbal 10. The tonal grooves are grooves that radiate along the radius of the cymbal. The tonal grooves are substantially linear grooves that extend essentially along the radius of the cymbal. The tonal grooves are substantially symmetrically spaced apart from one another. In such a configuration, the spacing between adjacent tonal grooves is substantially the same at a particular point along the radial axis of the cymbal. The tonal grooves as positioned on the cymbal such that as the grooves extend toward the peripheral edge 12 of the cymbal, the spacing between adjacent grooves increases. Consequently, the spacing between adjacent grooves is the smallest near the center of the cymbal and largest at or near the peripheral edge of the cymbal. Cymbal 10 preferably includes many tonal grooves on the top surface 14 of the cymbal. The spacing of the tonal grooves from one another will depend on the desired sound and tone to be produced by the cymbal. Preferably, the maximum spacing between adjacent tonal grooves less than about 5 inches, and more preferably less than about 3 inches, and even more preferably less than about 1 inch.

The tonal grooves are general formed by an automated process to obtain the desired symmetry of the tonal grooves on the cymbal; however, the tonal grooves could be formed manually or by a mold. The depth and width of the tonal grooves is selected to provide the desired sound and tonal qualities for the cymbal. The depth of the tonal groove is selected so as not to adversely compromise the strength and resiliency of the cymbal. Preferably, the depth and width of the tonal grooves is at least about 0.001 inch.

Figure 2:
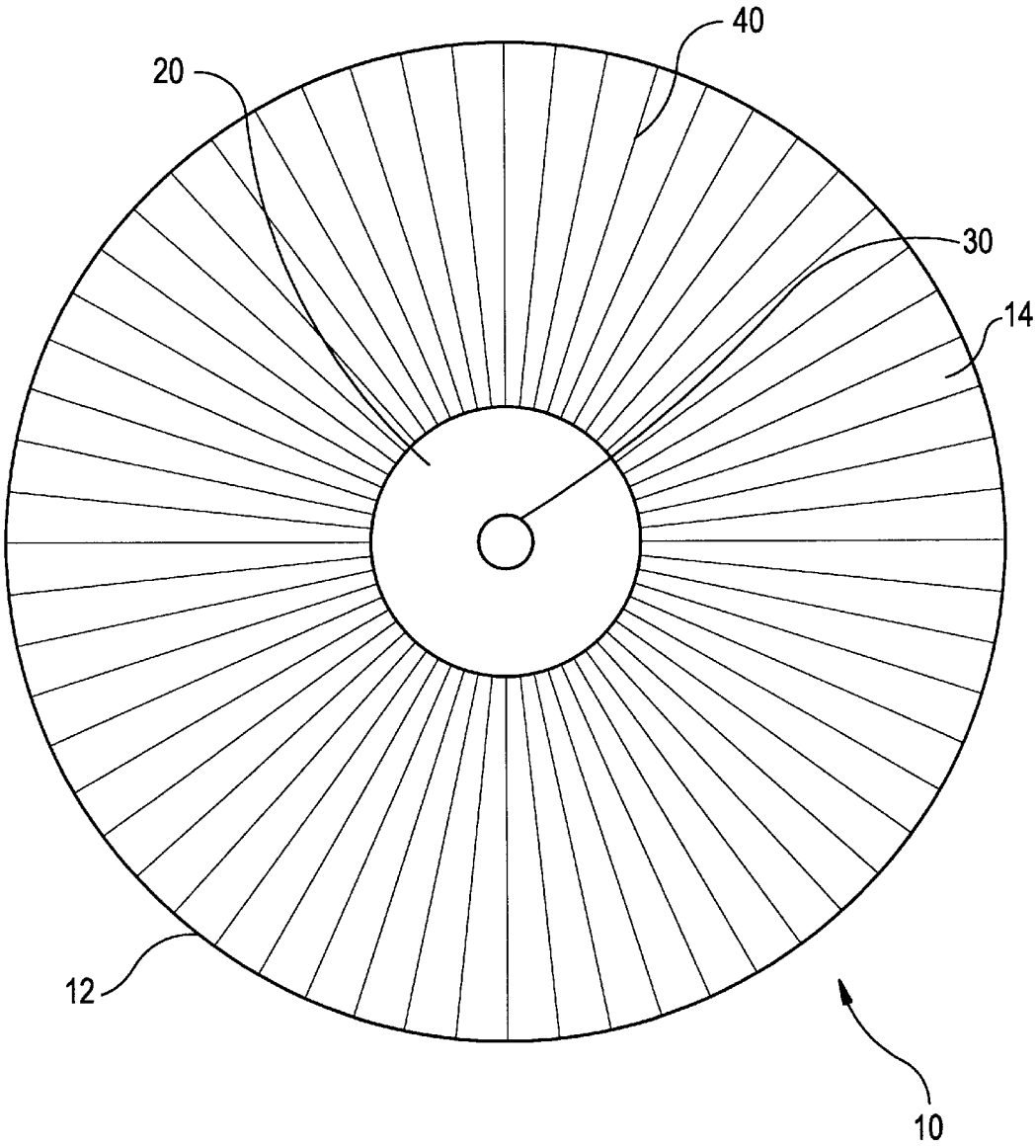
FIG. 2 is a top elevation view of an alternate embodiment of the cymbal of the present invention.

Referring now to FIG. 2, an alternate embodiment of the cymbal is illustrated. The tonal grooves in FIG. 2 are shown to be spaced from opening 30 on cymbal 10. The tonal grooves are shown to begin at the base of bell 20. As can be appreciated, one or more of the tonal grooves may begin at a pont between opening 30 and the end of bell 20. Preferably, the tonal grooves are spaced from opening 30 at least about 0.25 inch and preferably about 0.5–2 inches.

Figure 3:
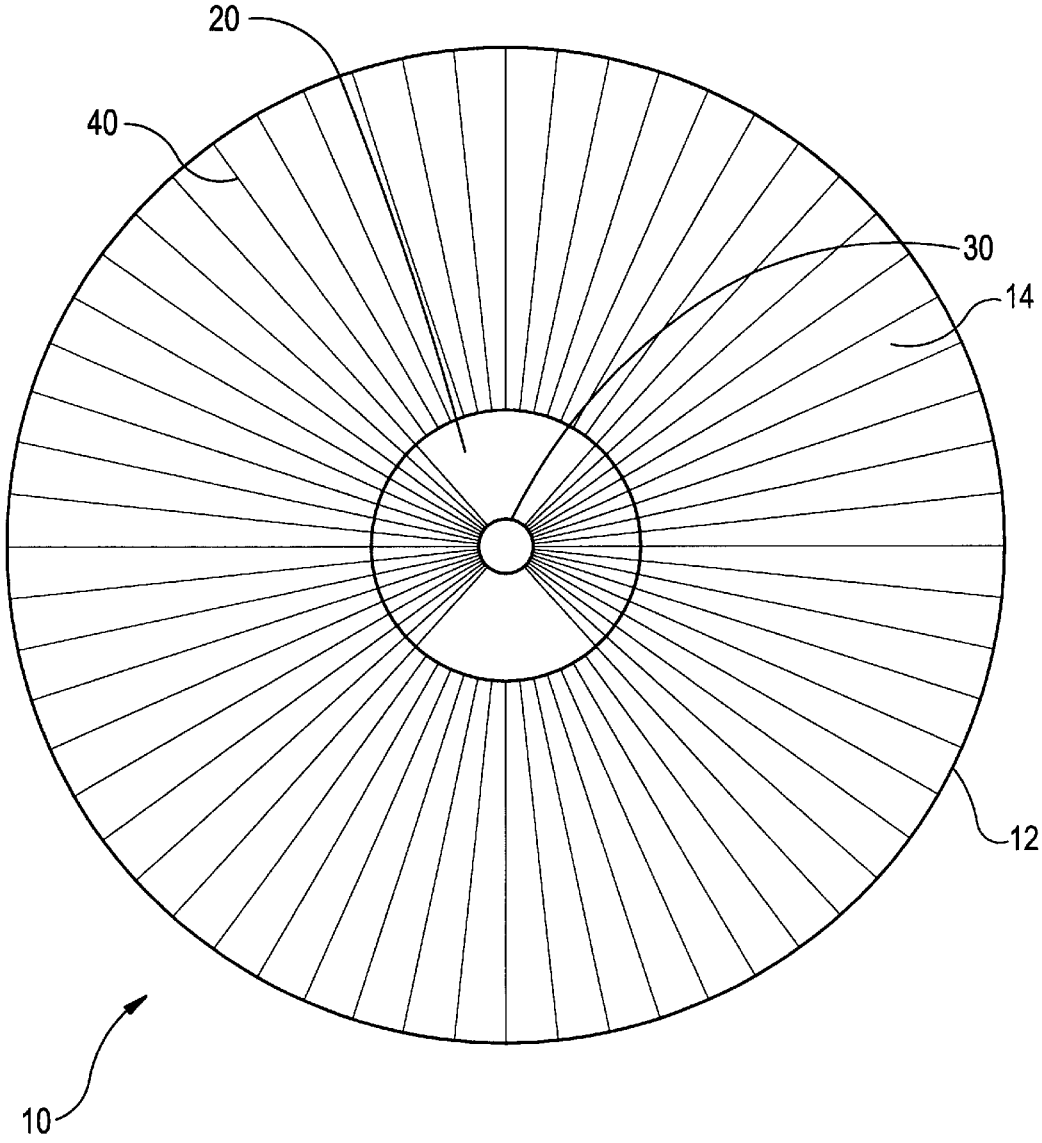
FIG. 3 is a top elevation view of another alternate embodiment of the cymbal of the present invention.

Referring now to FIG. 3, another alternate embodiment of the cymbal is illustrated. One or more of the tonal grooves are spaced from opening 30 and one or more of the tonal grooves extend to opening 30. The tonal grooves are formed such that a group of grooves extend to opening 30 and a group of grooves are spaced from opening 30. As can be appreciated, various patterns of groove positioning can be incorporated on the cymbal to obtain the desired sound and tone for the cymbal.

Figure 4:
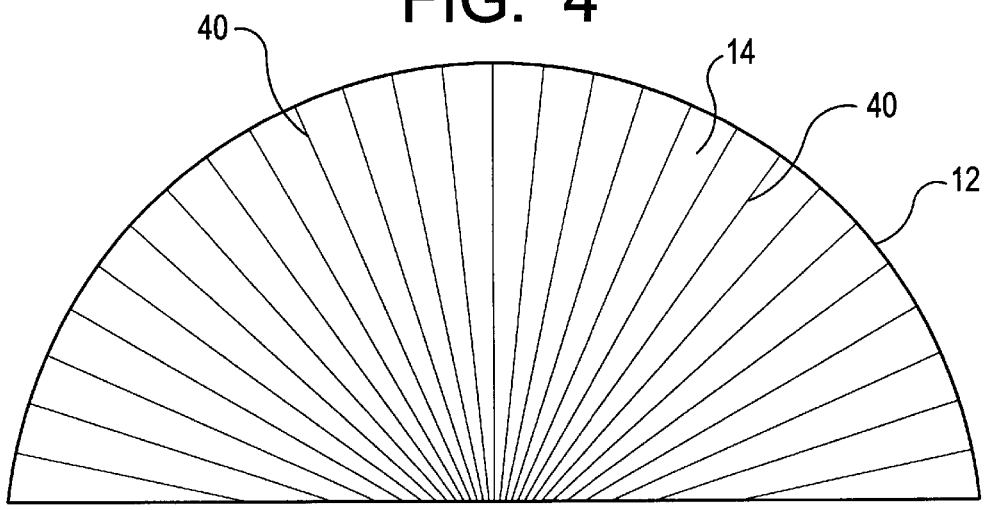
FIG. 4 is an enlarged partial top elevation view of the cymbal of FIG. 1 illustrating the tonal grooves extending to the edge of the cymbal.
Figure 5:
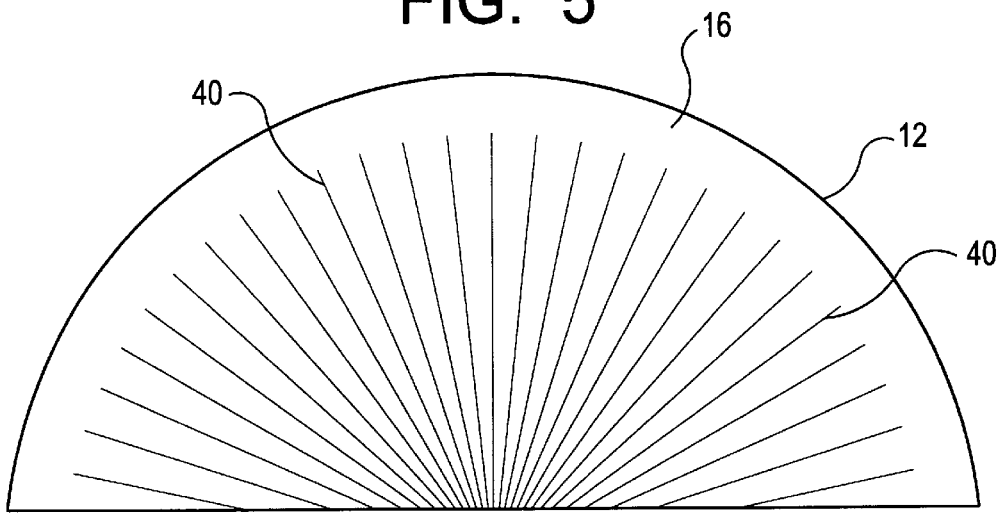
FIG. 5 is an enlarged partial bottom elevation view of the cymbal of FIG. 1 illustrating the tonal grooves extending to a position spaced from the edge of the cymbal.
Figure 6:
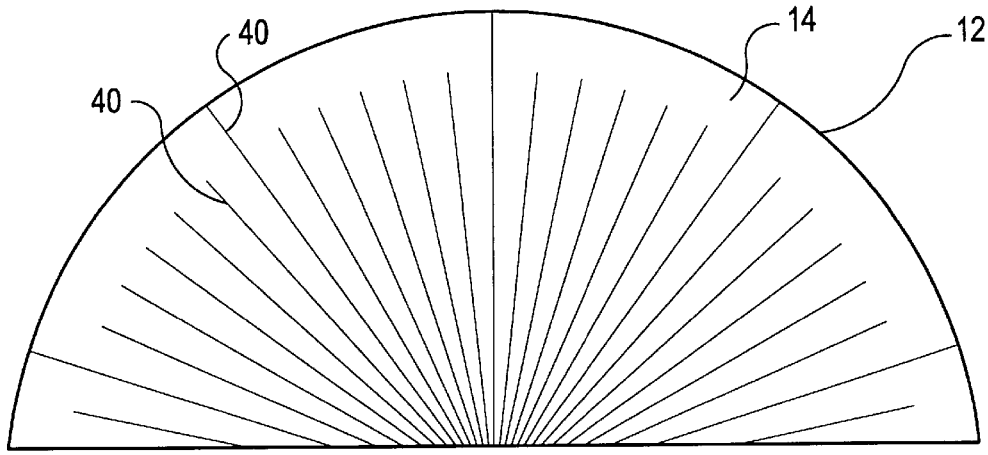
FIG. 6 is an enlarged partial top elevation view of an alternate embodiment the cymbal of FIG. 1 illustrating some of the tonal grooves extending to the edge of the cymbal and some the tonal grooves extending to a position spaced from the edge of the cymbal.

Referring now to FIGS. 4–6, an enlarged section of the end of the cymbal is shown. Referring to FIG. 4, the tonal grooves 40 are shown to be positioned on the top side 14 of cymbal 10 and extend to the peripheral edge 12. FIG. 5 illustrates an alternative embodiment of the cymbal. The tonal grooves are shown to be positioned on bottom side 16 of cymbal 10 and extend to a position that is spaced from peripheral edge 12. FIG. 6 illustrates another alternative embodiment of the cymbal. The tonal grooves are shown to be positioned on the top side 14 of cymbal 10 and a plurality of tonal grooves extend to the peripheral edge 12 and a plurality of tonal grooves extend to a positioned spaced from peripheral edge 12. The spacing of the tonal grooves from the edge of the cymbal to functions to reduce or repress some of the overtones from the cymbal when the cymbal is struck. By selecting the particular tonal groove pattern on the cymbal, the tone of the cymbal, and the richness of sound from the cymbal can be controlled.

Figure 7:
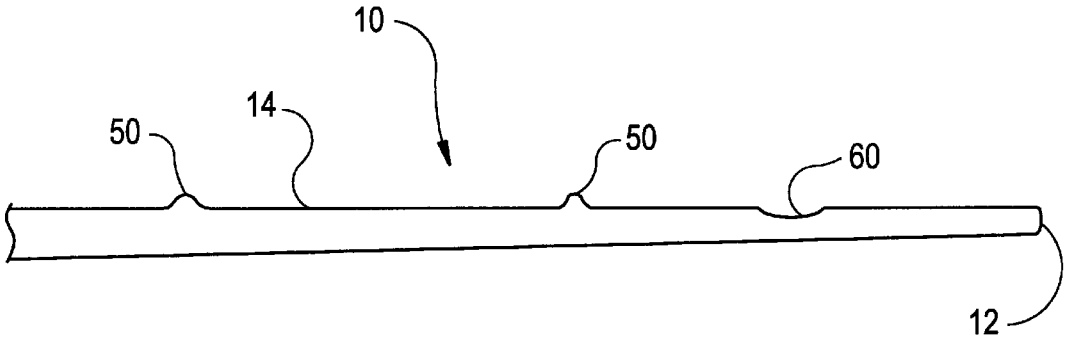
FIG. 7 is an enlarged cross-section of an alternative embodiment of the cymbal of FIG. 1 illustrating the surface of the cymbal having tone modifiers on the surface of the cymbal.
Figure 8:
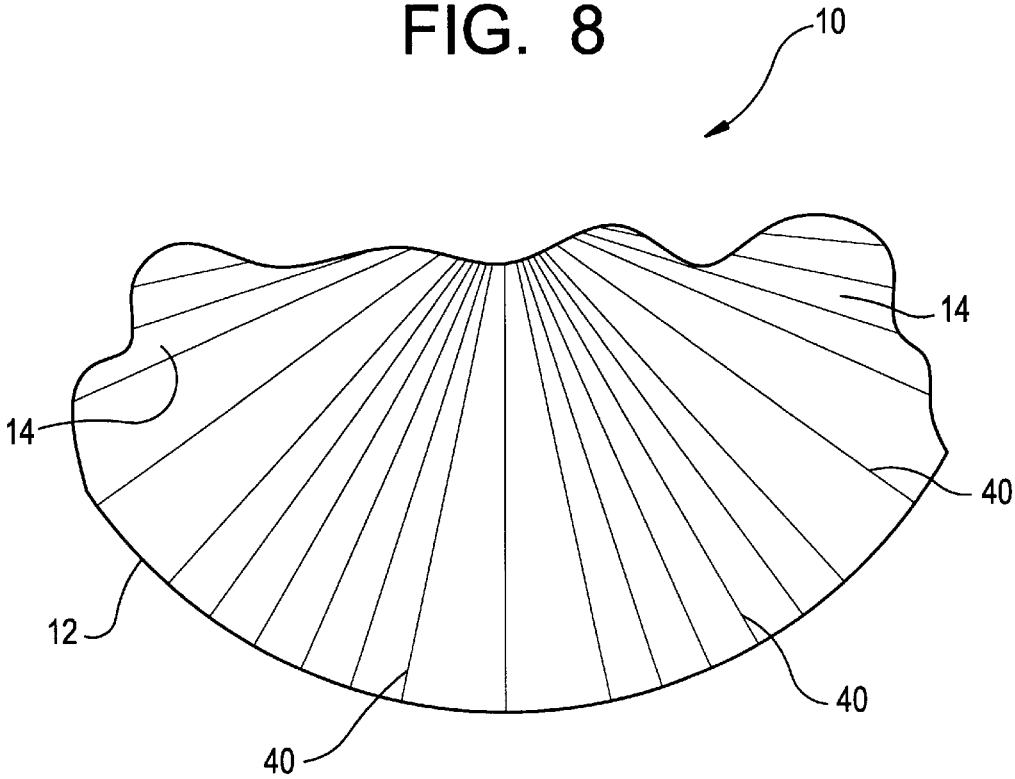
FIG. 8 is an enlarged view of the cymbal illustrating tonal grooves have a varying space relationship on the cymbal.
Figure 9:
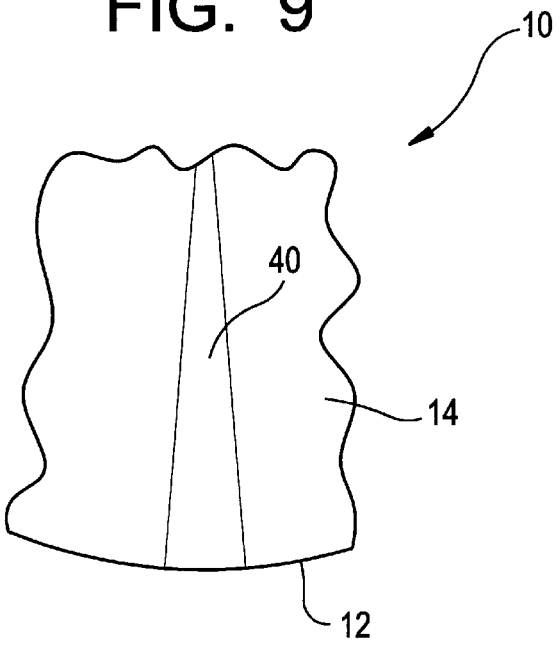
FIG. 9 is an enlarged view of the cymbal illustrating a tonal groove having a varying width.
Figure 10:
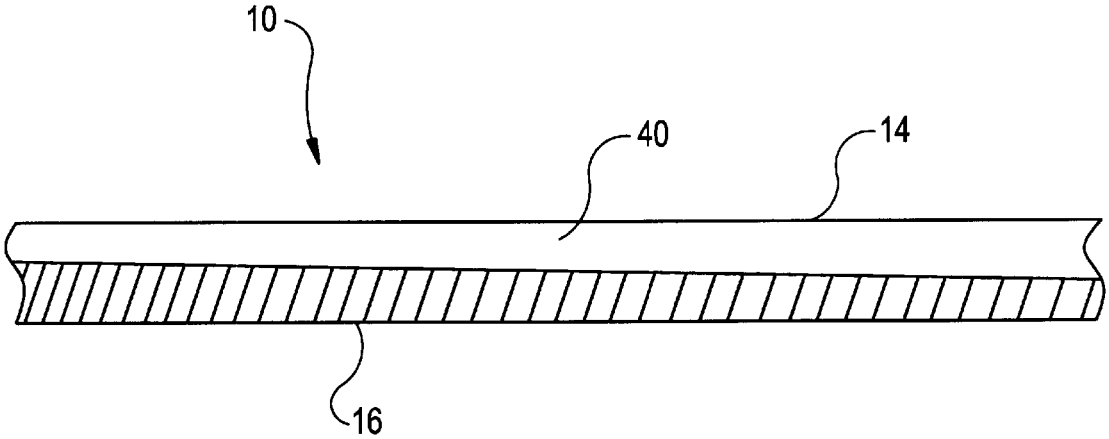
FIG. 10 is an enlarged cross-sectional view of a portion of a tonal groove illustrating the tonal groove having a varying depth.

Referring now to FIG. 7, another alternative embodiment of the cymbal is illustrated. An enlarged cross-sectional portion of the cymbal is shown. The top side 14 of the cymbal is shown to include tonal modifiers. In particular, the top side of the cymbal includes at least one rib 50. The one or more ribs 50 may be linear or arc shaped, or other shape. The top side of the cymbal is also shown as including one or more pits 60. Pits 60 are depressions in the surface of cymbal 10. As can be appreciated, the tonal modifiers, such as ribs 50 and/or pits 60, can be included on the bottom side of cymbal 10. Referring now to FIGS. 8–10, there is shown alternative embodiments of the invention. In FIG. 8, at least two tonal grooves 40 are shown to have a varying space relationship to one another as compared to the other tonal grooves 40 on cymbal 10. Referring now to FIG. 9, tonal groove 40 is shown to have a width that varies along the length of the tonal groove. Referring now to FIG. 10, tonal groove 40 is shown to have a depth that varies along the length of the tonal groove.

In summary, the present invention pertains to the unique placement of tonal grooves on a cymbal to produce a louder and richer sounding cymbal. The tonal grooves are positioned on the cymbal so that the tonal grooves are substantially linear in shape and preferably extend from the center of the cymbal and radiate outwardly toward the edge of the cymbal.

The invention has been described with reference to preferred embodiments and alternates thereof. It is believed that many modifications and alterations to the embodiments disclosed will readily suggest themselves to those skilled in the art upon reading and understanding the description of the invention and drawings of the invention. It is intended to include all such modifications and alterations insofar as they come within scope of the present invention.

I claim:

1. A cymbal comprising a bell section and a plate section extending from the bell section and a plurality of tonal grooves, at least two of said tonal grooves are substantially linear in shape, at least one of said substantially linear tonal grooves extending from at least from said bell section to at least closely adjacent to a peripheral edge of said plate section.

2. A cymbal as defined in claim 1, wherein said plate has a shaped selected from the group consisting of a circle, ellipse, and polygon.

3. A cymbal as defined in claim 2, wherein said at least one linear tonal groove extends at least closely adjacent to a center of said bell section to at least closely adjacent to said peripheral edge of said plate section.

4. A cymbal as defined in claim 3, wherein said at least one linear tonal groove extends from a center of said bell section to at least closely adjacent to said peripheral edge of said plate section.

5. A cymbal as defined in claim 2, wherein the tonal grooves are positioned on the bottom surface of the cymbal.

6. A cymbal as defined in claim 5, wherein said at least one linear tonal groove extends at least closely adjacent to a center of said bell section to at least closely adjacent to said peripheral edge of said plate section.

7. A cymbal as defined in claim 6, wherein said at least one linear tonal groove extends from a center of said bell section to at least closely adjacent to said peripheral edge of said plate section.

8. A cymbal as defined in claim 7, wherein said at least one linear tonal groove extends substantially to the edge of the cymbal.

9. A cymbal as defined in claim 8, wherein at least two of said linear tonal grooves are symmetrically oriented on said cymbal.

10. A cymbal as defined in claim 2, wherein the tonal grooves are positioned on the top surface of the cymbal.

11. A cymbal as defined in claim 10, wherein said at least one linear tonal groove extends at least closely adjacent to a center of said bell section to at least closely adjacent to said peripheral edge of said plate section.

12. A cymbal as defined in claim 11, wherein said at least one linear tonal groove extends from a center of said bell section to at least closely adjacent to said peripheral edge of said plate section.

13. A cymbal as defined in claim 12, wherein at least one of said linear tonal grooves extending to a point which is spaced from the peripheral edge of said plate section.

14. A cymbal as defined in claim 12, wherein said at least one linear tonal groove extends substantially to the edge of the cymbal.

15. A cymbal as defined in claim 14, wherein at least two of said linear tonal grooves are symmetrically oriented on said cymbal.

16. A cymbal as defined in claim 14, wherein said at least two linear tonal grooves are substantially uniformly spaced from one another.

17. A cymbal as defined in claim 14, wherein said at least two linear tonal grooves have a varying space relationship to one another as compared to the other tonal grooves on the cymbal.

18. A cymbal as defined in claim 14, wherein at least one of said linear tonal grooves has a depth, which depth is substantially uniform throughout the length of the tonal groove.

19. A cymbal as defined in claim 14, wherein at least one of said linear tonal grooves has a depth that varies along the length of the tonal groove.

20. A cymbal as defined in claim 14, wherein at least one of said linear tonal grooves has a width that is substantially uniform along the length of the tonal groove.

21. A cymbal as defined in claim 14, wherein at least one of said linear tonal grooves has a width that varies along the length of the tonal groove.

22. A cymbal as defined in claim 14, wherein at least two of said linear tonal grooves have substantially the same length.

23. A cymbal as defined in claim 14, including at least one tonal modifier, said tonal modifier selected from the group consisting of a rib, a pit, a circular tonal groove, a score line, a chemical surface treatment, or a coating.

24. A cymbal as defined in claim 1, wherein the tonal grooves are positioned on the top surface of the cymbal.

25. A cymbal as defined in claim 1, wherein the tonal grooves are positioned on the bottom surface of the cymbal.

26. A cymbal as defined in claim 1, wherein said at least one linear tonal groove extends at least closely adjacent to a center of said bell section to at least closely adjacent to said peripheral edge of said plate section.

27. A cymbal as defined in claim 26, wherein said at least one linear tonal groove extends from a center of said bell section to at least closely adjacent to said peripheral edge of said plate section.

28. A cymbal as defined in claim 26, wherein said at least one linear tonal groove extends substantially to the edge of the cymbal.

29. A cymbal as defined in claim 1, wherein said at least one linear tonal groove extends substantially to the edge of the cymbal.

30. A cymbal as defined in claim 1, wherein at least two of said linear tonal grooves are substantially uniformly spaced from one another.

31. A cymbal as defined in claim 1, wherein at least two of said linear tonal grooves have a varying space relationship to one another as compared to the other tonal grooves on the cymbal.

32. A cymbal as defined in claim 1, wherein at least one of said linear tonal grooves has a depth, which depth is substantially uniform throughout the length of the tonal groove.

33. A cymbal as defined in claim 1, wherein at least one of said linear tonal grooves has a depth that varies along the length of the tonal groove.

34. A cymbal as defined in claim 1, wherein at least two of said linear tonal grooves are symmetrically oriented on said cymbal.

35. A cymbal as defined in claim 1, wherein at least one of said linear tonal grooves has a width that is substantially uniform along the length of the tonal groove.

36. A cymbal comprising a plate which includes tonal grooves, which tonal grooves are substantially linear in shape, at least one tonal groove has a width that varies along the length of the tonal groove.

37. A cymbal as defined in claim 1, wherein at least two of said linear tonal grooves have substantially the same length.

38. A cymbal as defined in claim 1, including at least one tonal modifier, said tonal modifier selected from the group consisting of a rib, a pit, a circular tonal groove, a score line, a coating, and combinations thereof.

39. A cymbal as defined in claim 1, wherein the thickness of said plate section varies.

40. A cymbal as defined in claim 1, wherein the thickness of said plate section varies.

41. A cymbal as defined in claim 1, wherein at least one of said linear tonal grooves extending to a point which is spaced from the peripheral edge of said plate section.

42. A cymbal as defined in claim 1, wherein at least one of said linear tonal grooves has a width that varies along the length of the tonal groove.

43. A cymbal comprising a plate which includes tonal grooves, which tonal grooves are substantially linear in shape, at least one tonal groove extending to a point which is spaced from the edge of the cymbal.

44. A cymbal comprising a plate section and a plurality of tonal grooves, said plate section having an inner peripheral edge and an outer peripheral edge, at least two of said tonal grooves are substantially linear in shape, at least one of said substantially linear tonal grooves extending from at least closely adjacent to said inner peripheral edge to at least closely adjacent to said outer peripheral edge of said plate section.

45. A cymbal as defined in claim 44, wherein at least one of said linear tonal grooves extending at least from said inner peripheral edge to at least closely adjacent to said outer peripheral edge of said plate section.

46. A cymbal as defined in claim 45, wherein at least one of said linear tonal grooves extending to said outer peripheral edge of said plate section.

47. A cymbal as defined in claim 46, including a bell section, said bell section attached to at least a portion of said inner peripheral edge of said plate section.

48. A cymbal as defined in claim 47, wherein at least one of said linear tonal grooves extending on to said bell section.

49. A cymbal as defined in claim 44, wherein at least one of said linear tonal grooves extending to said outer peripheral edge of said plate section.

50. A cymbal as defined in claim 44, including a bell section, said bell section attached to at least a portion of said inner peripheral edge of said plate section.

51. A cymbal as defined in claim 50, wherein at least one of said linear tonal grooves extending on to said bell section.

52. A musical instrument that includes a plate section that produces a sound when struck, said plate section including a plurality of tonal grooves, said plate section having an inner peripheral edge and an outer peripheral edge, said inner peripheral edge adjacent to an opening, at least two of said tonal grooves are substantially linear in shape, at least one of said substantially linear tonal grooves extending from at least closely adjacent to said inner peripheral edge to at least closely adjacent to said outer peripheral edge of said plate section.

53. A musical instrument as defined in claim 52, wherein said musical instrument is a cymbal.

* * * * *